US010849808B2

(12) United States Patent
Catacchio et al.

(10) Patent No.: US 10,849,808 B2
(45) Date of Patent: Dec. 1, 2020

(54) RECONFIGURABLE PATIENT SUPPORT DEVICE AND PATIENT SUPPORT SYSTEM

(71) Applicant: Allen Medical Systems, Inc., Batesville, IN (US)

(72) Inventors: Anthony V. Catacchio, Rochdale, MA (US); Andrew D. Clark, Waltham, MA (US); Phillip B. Dolliver, Framingham, MA (US); Jesse S. Drake, Westborough, MA (US); Christopher B. Dubois, Marlborough, MA (US); Zachary B. Konsin, Brighton, MA (US); Michael C. Pierce, Harvard, MA (US)

(73) Assignee: Allen Medical Systems, Inc., Batesville, IN (US)

( * ) Notice: Subject to any disclaimer, the term of this patent is extended or adjusted under 35 U.S.C. 154(b) by 840 days.

(21) Appl. No.: 15/453,980

(22) Filed: Mar. 9, 2017

(65) Prior Publication Data

US 2018/0185228 A1 Jul. 5, 2018

Related U.S. Application Data

(60) Provisional application No. 62/442,598, filed on Jan. 5, 2017.

(51) Int. Cl.
*A61G 13/08* (2006.01)
*A61G 13/06* (2006.01)
(Continued)

(52) U.S. Cl.
CPC ..... *A61G 13/08* (2013.01); *A61G 13/0081* (2016.11); *A61G 13/04* (2013.01);
(Continued)

(58) Field of Classification Search
CPC .... A61G 13/08; A61G 13/0081; A61G 13/04; A61G 13/06; A61G 13/104;
(Continued)

(56) References Cited

U.S. PATENT DOCUMENTS 5,088,706 A 2/1992 Jackson
5,131,106 A 7/1992 Jackson
(Continued)

FOREIGN PATENT DOCUMENTS

CN 204684067 U 10/2015

OTHER PUBLICATIONS

Office Action for JP Application 2017-241668; dated Feb. 26, 2019.
(Continued)

*Primary Examiner* — David R Hare
*Assistant Examiner* — Adam C Ortiz
(74) *Attorney, Agent, or Firm* — Barnes & Thornburg LLP

(57) ABSTRACT

A patient support device includes an alternate support top, a head support unit partially supporting the alternate support top, a foot support unit longitudinally spaced from the head support unit and an adaptor associated with the foot support unit. The adaptor is securable to the foot support unit so that the adaptor and foot support unit cooperate to partially support the alternate support top so that the alternate support top extends footwardly beyond the foot support unit. The roles of the head and foot support units may be reversed. A related patient support system includes a baseline set of support tops and a set of alternate support tops.

18 Claims, 10 Drawing Sheets

(51) Int. Cl.

| | |
|---|---|
| ***A61G 13/04*** | (2006.01) |
| ***A61G 13/00*** | (2006.01) |
| ***A61G 13/10*** | (2006.01) |
| ***A61G 13/12*** | (2006.01) |

(52) U.S. Cl.
CPC ..... *A61G 13/06* (2013.01); *A61G 13/104* (2013.01); *A61G 13/121* (2013.01); *A61G 13/125* (2013.01); *A61G 13/126* (2013.01); *A61G 13/129* (2013.01); *A61G 13/1235* (2013.01); *A61G 2200/325* (2013.01); *A61G 2205/60* (2013.01)

(58) Field of Classification Search
CPC ..... A61G 13/121; A61G 13/1235; A61G 13/125; A61G 13/126; A61G 13/129; A61B 6/0407
See application file for complete search history.

(56) References Cited

U.S. PATENT DOCUMENTS

| | | | | |
|---|---|---|---|---|
| 5,279,011 | A * | 1/1994 | Schnelle | A61G 13/08 5/616 |
| 6,262,220 | B1 | 7/2001 | Lamb et al. | |
| 7,152,261 | B2 * | 12/2006 | Jackson | A61G 13/0036 5/600 |
| 7,739,762 | B2 | 6/2010 | Lamb et al. | |
| 8,826,474 | B2 | 9/2014 | Jackson | |
| 9,095,489 | B2 | 8/2015 | Berry et al. | |
| 2004/0133983 | A1 | 7/2004 | Newkirk et al. | |
| 2006/0096033 | A1 | 5/2006 | Wong et al. | |
| 2009/0282614 | A1 | 11/2009 | Jackson | |
| 2014/0359941 | A1 * | 12/2014 | Sharps | A61G 13/04 5/610 |
| 2015/0202106 | A1 | 7/2015 | Hight et al. | |
| 2015/0265482 | A1 | 9/2015 | Ciblak et al. | |
| 2017/0040664 | A1 * | 2/2017 | Tockweiler | A61G 13/02 |
| 2019/0209409 | A1 * | 7/2019 | Jackson | A61B 6/0407 |

OTHER PUBLICATIONS

Response to JP Office Action dated Jul. 5, 2019 for JP Application 2017-241668.

European Search Report for E P Application 17208254.7; dated May 22, 2018; Place of search—The Hague; Date of completion of the search—May 11, 2018; Examiner—Gkama, Alexandra.

Decision of Rejection for JP Application No. 2017-241668; dated Jan. 7, 2020.

Response to European Search Report for EP Application 17208254.7 dated Jan. 9, 2019.

Amended Pages (Tracked) to Response to European Search Report for EP Application 17208254.7.

Amended Pages (Final) to Response to European Search Report for EP Application 17208254.7.

Claims (Tracked) to Response to European Search Report for EP Application 17208254.7.

Claims (Final) to Response to European Search Report for EP Application 17208254.7.

* cited by examiner

RECONFIGURABLE PATIENT SUPPORT DEVICE AND PATIENT SUPPORT SYSTEM

TECHNICAL FIELD

The subject matter described herein relates to surgical tables and particularly to a surgical table which provides a surgeon and other members of the surgical staff with improved access to a patient's surgical site.

BACKGROUND

A typical surgical table includes head end and foot end support units and a support top which spans between and is supported by the support units. The typical arrangement of the support top relative to the support units may be satisfactory for many surgeries. For other surgeries the typical arrangement may be suboptimal because it does not always afford the surgeon optimal access to the patient's surgical site. This application describes a reconfigurable surgical table that improves the surgeon's access to the surgical site.

SUMMARY

One embodiment of a patient support device comprises an alternate support top, a head support unit partially supporting the alternate support top, a foot support unit longitudinally spaced from the head support unit, and an adaptor associated with the foot support unit. The adaptor is securable to the foot support unit so that the adaptor and foot support unit cooperate to partially support the alternate support top so that the alternate support top extends footwardly beyond the foot support unit.

Another embodiment of the patient support device comprises a head support unit, a foot support unit, a connecting member extending longitudinally between the head support unit and the foot support unit and connecting the units together, and a crown attachable to and detachable from the foot support unit.

An embodiment of a patient support system comprises a first or baseline set of support tops having at least one member, a head support unit, and a foot support unit longitudinally spaced from the head support unit. The head support unit and the foot support unit have a baseline configuration such that each member of the first set of support tops is supportable partially by the head support unit and partially by the foot support unit. The patient support system also includes a second or alternate set of support tops having at least one member. The members of the second set of support tops are unsupportable by the baseline configured head support unit and foot support unit, however the head support unit, the foot support unit or both are reconfigurable to a non-baseline configuration so that each member of the second set is supportable partially by the head support unit and partially by the foot support unit.

BRIEF DESCRIPTION OF THE DRAWINGS

The foregoing and other features of the various embodiments of the patient support device and patient support system described herein will become more apparent from the following detailed description and the accompanying drawings in which.

DETAILED DESCRIPTION

Figure 1A:
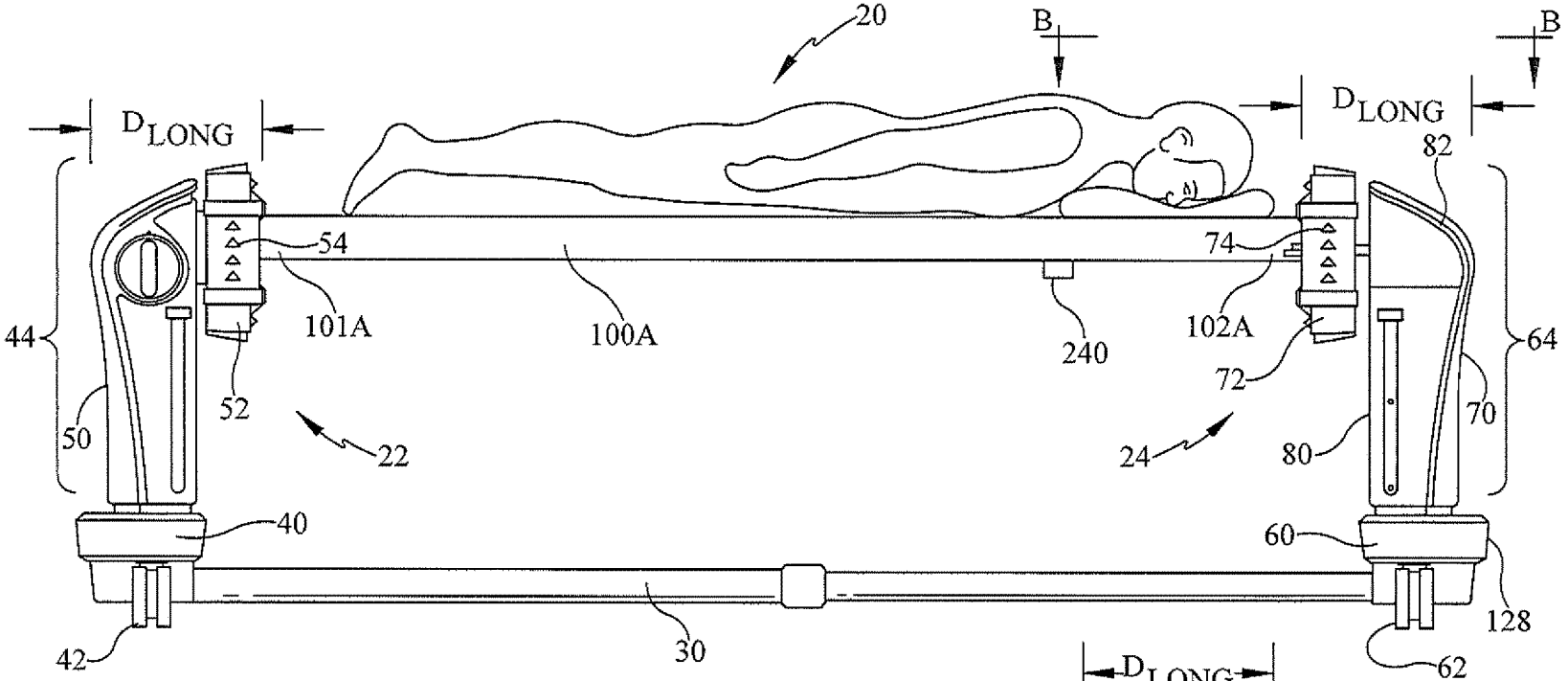
FIG. 1A is a side elevation view showing a patient support device with a patient supported thereon in a prone position, the patient support device having a head support unit, a foot support unit and a baseline support top, the support device being shown in a baseline configuration but being reconfigurable between the baseline configuration and an alternate configiration.

Reference will now be made to embodiments of the invention, examples of which are illustrated in the accompanying drawings. Features similar to or the same as features already described may be identified by the same reference numerals already used. The terms "substantially" and "about" may be used herein to represent the inherent degree of uncertainty that may be attributed to any quantitative comparison, value, measurement or other representation. These terms are also used herein to represent the degree by which a quantitative representation may vary from a stated reference without resulting in a change in the basic function of the subject matter at issue.

Referring to FIGS. 1A-4, a patient support device such as a surgical table 20 includes a head support unit 22 and a foot support unit 24 spaced longitudinally from the head support unit. As is evident from FIGS. 3A and 4 "head" and "foot" are used to distinguish between the two support units but do not necessarily correspond to the orientation of the patient.

A connecting member 30 extends longitudinally between the head support unit and the foot support unit and connects the support units to each other. The connecting member may be a fixed length member or may be an adjustable length member constructed of, for example, telescoping tubes.

Head unit 22 comprises a base 40, casters 42 extending from the bottom of the base, and a column 44 extending vertically upwardly from the base. The column comprises a primary elevator 50 which is height adjustable relative to base 40, for example by a hydraulic system. The column also includes a secondary elevator 52 attached to the primary elevator. The height of the secondary elevator relative to primary elevator is fixed, however the secondary elevator includes two or more attachment stations 54 to which a first end 101A of a baseline patient support top 100A can be attached. The baseline support top 100A is a member of a set of baseline support tops indicated generally by reference numeral 100. The attachment stations are indicated schematically by triangular symbols and are vertically separated from each other.

Figure 2:
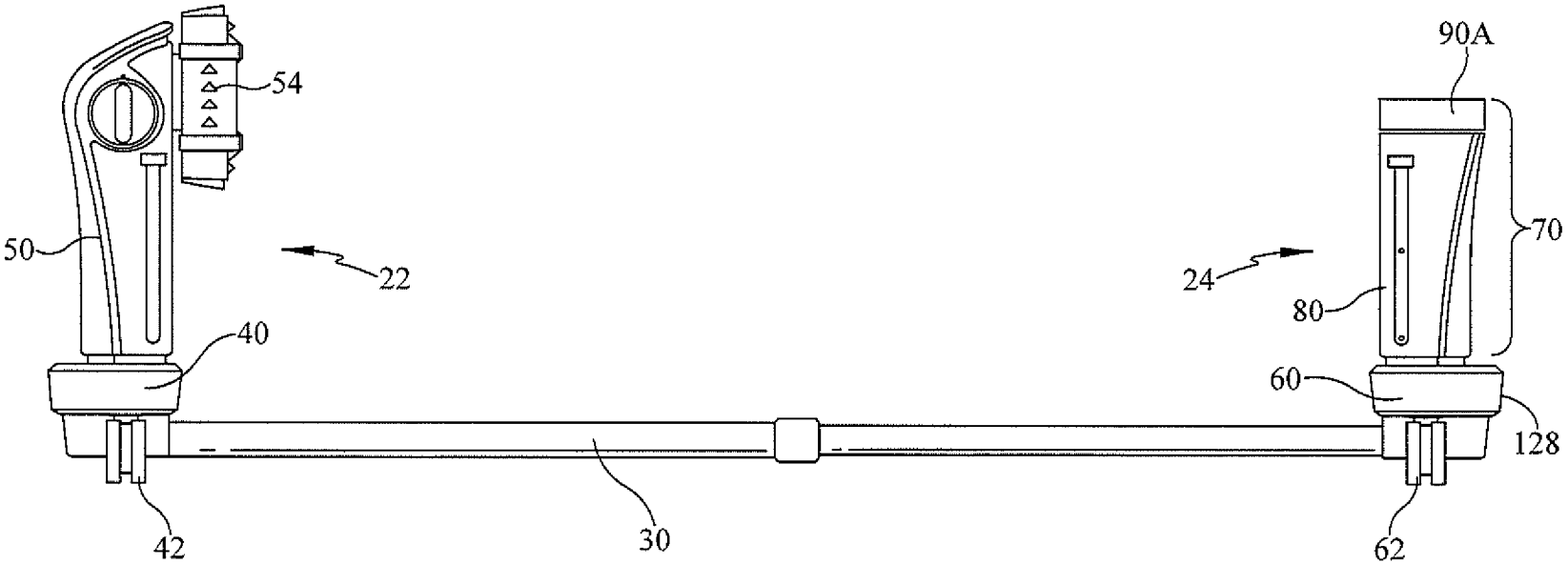
FIG. 2 is a view similar to FIG. 1A with the support top removed and with an adaptor having been installed on the pedestal of the foot support unit in lieu of the crown of FIG. 1A.

Foot unit 24 comprises a base 60, casters 62 extending from the bottom of the base, and a column 64 extending vertically upwardly from the base. The column comprises a primary elevator 70 which includes a pedestal portion 80 and a crown 82. The crown is attachable to and detachable from the pedestal. The primary elevator is height adjustable relative to base 60, for example by a hydraulic system. The column also includes a secondary elevator 72 attached to the primary elevator, specifically to crown 82. The height of the secondary elevator relative to primary elevator is fixed, however the secondary elevator includes two or more attachment stations 74 to which a second end 102A of patient support top 100A can be attached. The attachment stations are indicated schematically by triangle symbols and are vertically separated from each other. Crown 82 is attachable to and detachable from pedestal 80. FIG. 1A shows the crown attached to the pedestal so that the primary elevator comprises the pedestal and the crown. FIG. 2 shows the crown having been removed and replaced by an adaptor 90A, which is described in more detail below, so that the primary elevator comprises the pedestal and the adaptor.

The first end 101A of the support top is attached to the head secondary elevator 52 at a selected attachment station 54, and the second end 102A of the support top is attached to the foot secondary elevator 72 at a selected attachment station 74. "First" and "second" are used herein to conveniently distinguish between longitudinally opposite ends of the support top but do not necessarily correspond to the orientation of the patient. The secondary elevators 52, 72 are the interfaces between the longitudinal ends 101A, 102A of the support top 100A and the support units 22, 24. The load borne by the secondary elevators is transferred to the floor by way of the primary elevators 50, 70, bases 40, 60 and casters 42, 62. In practice, a staff member chooses attachment stations and heights of the height adjustable primary elevators to position the patient at a desired height and inclination (e.g. level, inclined head down, inclined foot down).

Figure 3A:
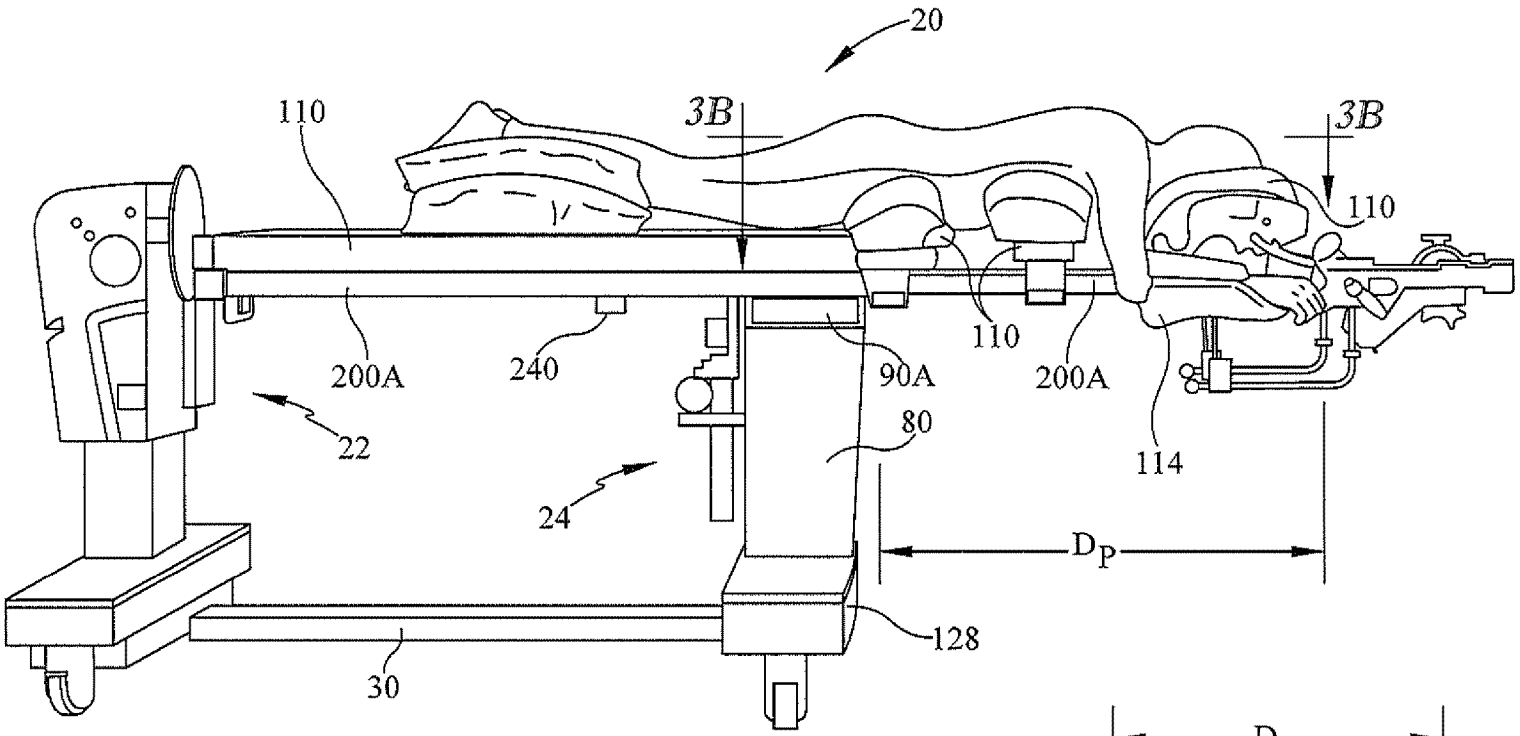
FIG. 3A is a view similar to FIG. 1A and FIG. 2 showing the support device in the alternate configuration in which the support top is an alternate support top which is used for prone surgery.
Figure 3B:
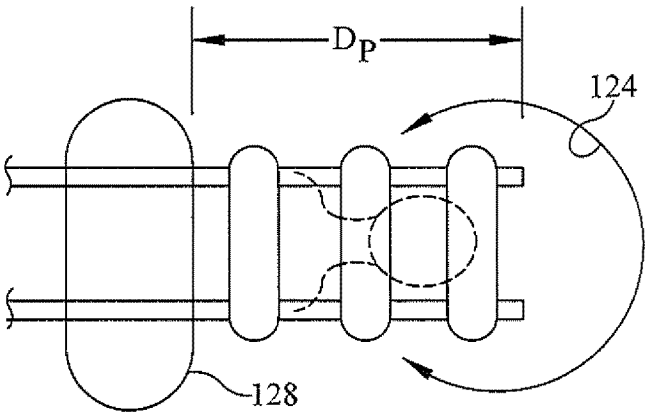
FIG. 3B is a plan view taken in the direction 3B-3B of FIG. 3A showing a phantom outline of the patient.
Figure 4:
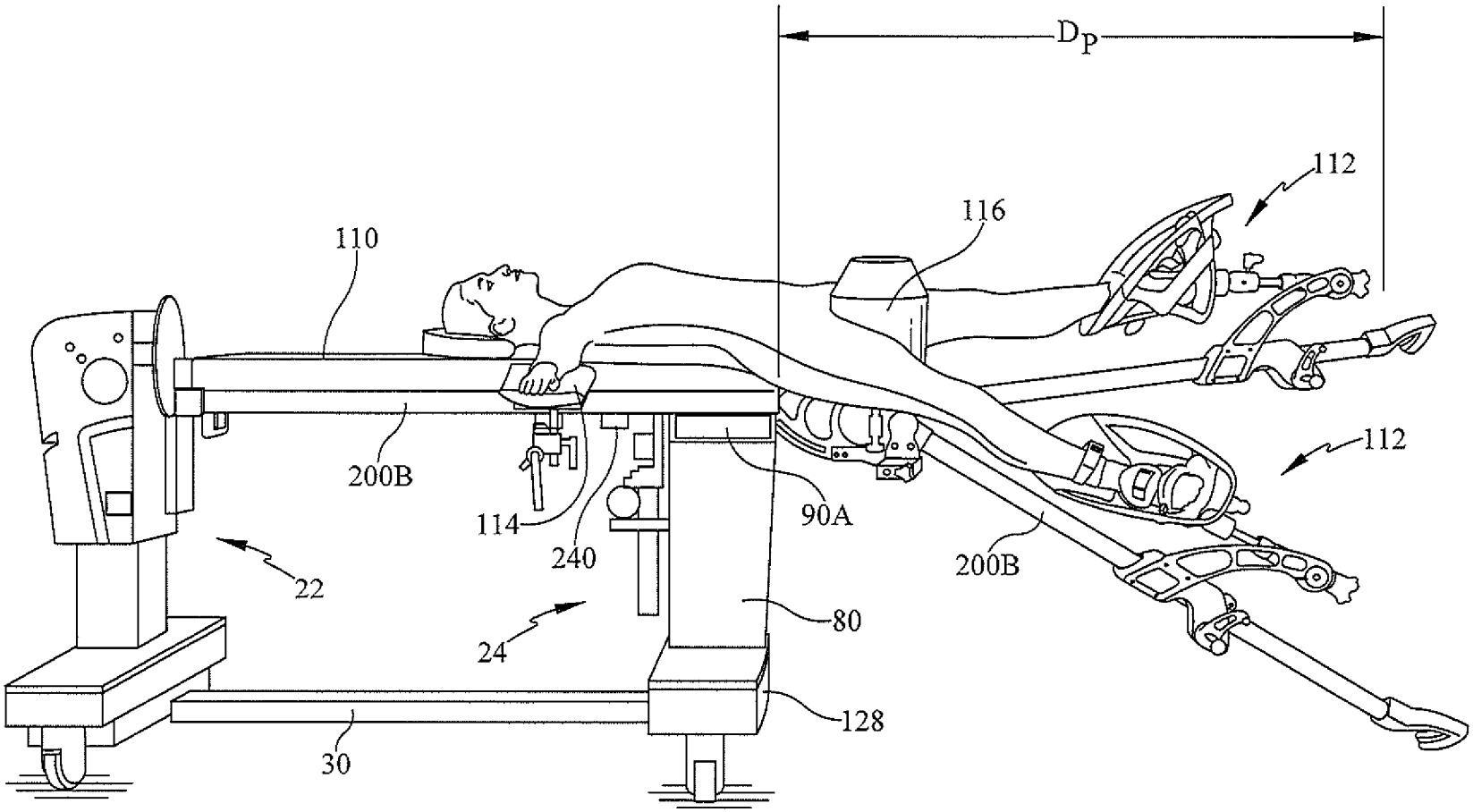
FIG. 4 is a view similar to FIG. 3A and FIG. 2 showing the support device in the alternate configuration in which the support top is an alternate support top which is used for hip surgery.

Various accessories may be attached to the baseline support top as well as to the members of set of alternate support tops which are described more completely below and are illustrated in FIGS. 3A, 3B and 4. Example accessories are illustrated only in connection with the alternate support tops of FIGS. 3A, 3B and 4. The example accessories include pads 110, traction assemblies 112, limb supports 114, and perineal posts 116.

Figure 1B:
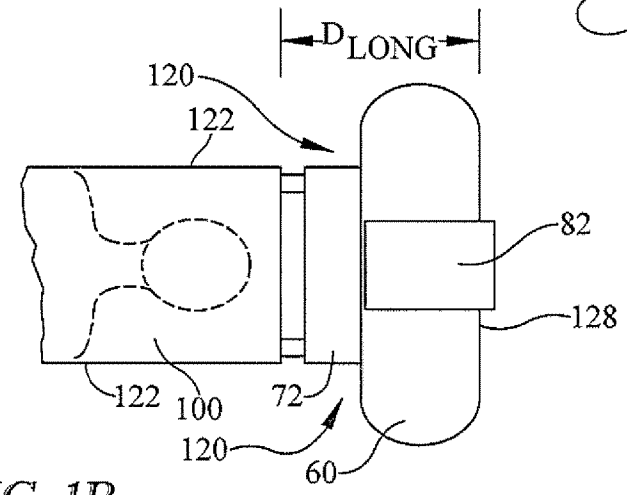
FIG. 1B is a plan view taken in the direction 1B-1B of FIG. 1A. showing a phantom outline of the patient.

At least the foot support unit, and therefore the patient support device as a whole, is configurable in a baseline configuration. The baseline configuration includes a baseline support top 100A and crown 82 as seen in FIGS. 1A and 1B. At least the foot support unit, and therefore the patient support device as a whole, is also configurable in a non-baseline configuration. The non-baseline configuration includes an alternate support top such as a prone surgery support top 200A of FIG. 3A or a hip surgery support top 200B of FIG. 4. The alternate support tops 200A, 200B are members of a set of alternate support tops indicated generally by reference numeral 200. The terms "non-baseline" and "alternate" are used herein to differentiate between different configurations and support tops, not to suggest that the alternate configurations and tops are inferior or less preferred in comparison to a baseline configuration or support top.

FIGS. 1A and 1B show the foot support unit, and therefore the patient support device as a whole, configured in the baseline configuration in which crown 82 resides atop pedestal 80 and is physically connected thereto. As used herein, "atop" means "on top of", not just at the same elevation or approximately the same elevation. Even when the crown is not connected to the pedestal it is nevertheless associated with the pedestal and the foot support unit in the sense that it is attachable to and detachable from the pedestal. The crown is compatible with supporting a baseline support top but is incompatible with supporting an alternate support top. Accordingly, the baseline configuration includes a baseline top, such as top 100A of FIG. 1A, selected from a first or baseline set of support tops having at least one member. The first end of the baseline top is attached to secondary elevator of the head support unit. The second end of the baseline support top is attached to secondary elevator of the foot support unit.

When a baseline support top is used, the head support unit and the foot support unit each partially support the baseline support top and, taken collectively, support all the weight of the support top. As used herein, unless specified otherwise, the weight of the baseline support top includes the weight of the support top itself and any weight borne by the support top (e.g. the weight of any accessories and of the patient).

The baseline arrangement of the support top relative to the support units may be satisfactory for many surgeries but may be suboptimal for others. If the surgeon stands to the right of the foot support unit as seen in FIGS. 1A and 1B, the surgeon is longitudinally separated from the patient by at least distance $D_{LONG}$, which may be unsatisfactory. If the surgeon is conducting surgery on the patient's cervical spine, she may be constrained to stand in the corner 122 defined by support unit base 60 and the edge 122 of the support top and therefore may not be able to position or maneuver her body for best access to the surgical site.

Figure 1C:
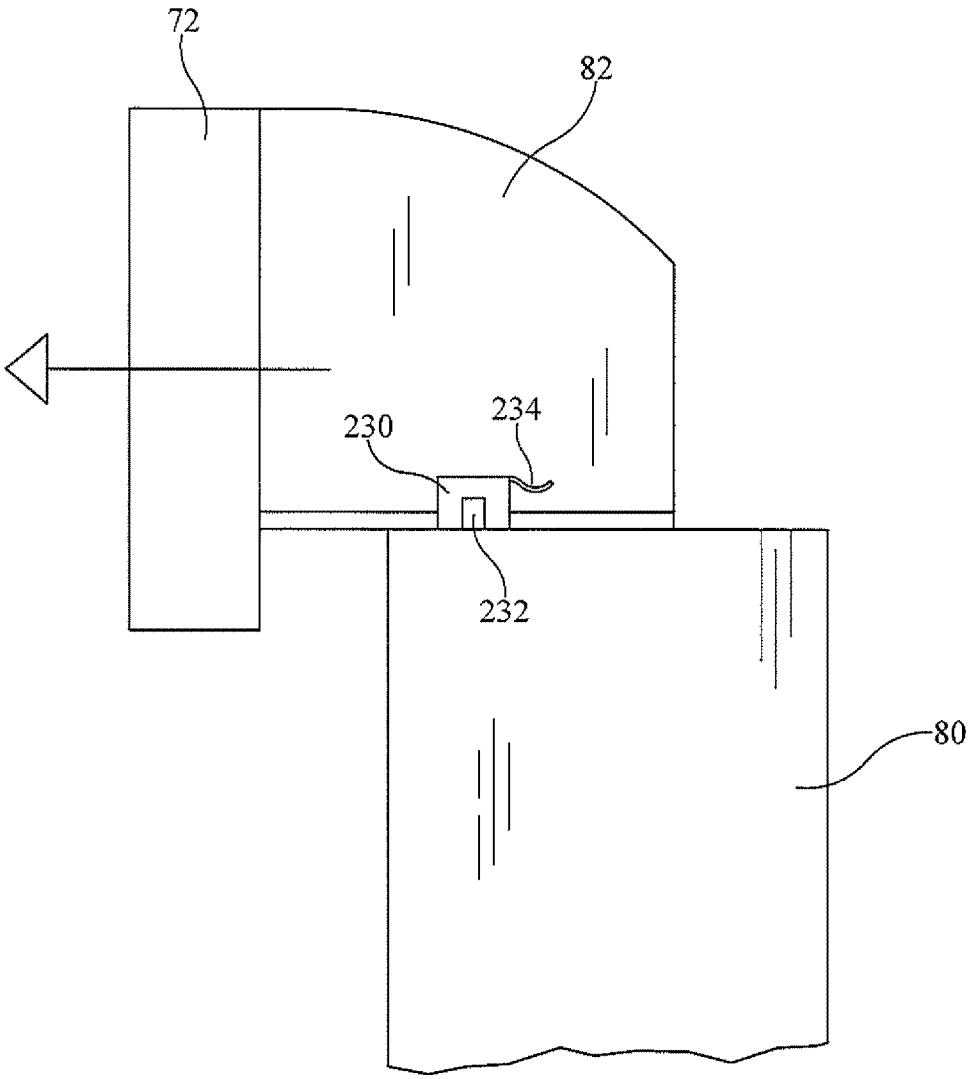
FIG. 1C is an elevation view of the foot support unit of FIGS. 1A and 1B showing a crown component of the unit being removed from a pedestal component of the unit.

FIGS. 2, 3A, 3B and 4 show the foot support unit, and therefore the patient support device as a whole, configured in the non-baseline configuration. In the non-baseline configuration, adaptor 90A resides atop pedestal 80 in lieu of crown 82 of the baseline configuration. FIG. 1C shows the crown being removed from the pedestal in preparation for securement of the adaptor to the pedestal. Use of the crown and the adaptor is mutually exclusive. The adaptor is physically connected to the pedestal. Even when the adaptor is not connected to the pedestal it is nevertheless associated with the pedestal and the foot support unit in the sense that it is securable to and removable from the pedestal. The adaptor is compatible with supporting an alternate support top but is incompatible with supporting a baseline support top. Accordingly the non-baseline configuration includes an alternate top, such as tops 200A, 200B of FIGS. 3A and 4, selected from a second or alternate set of support tops having at least one member. The alternate support top is attached to secondary elevator 52 of the head support unit. The alternate support top is also attached to secondary elevator 72 of the foot support unit. The alternate support top and the adaptor are distinct components, i.e. they are not integrated into a single unit.

When an alternate support top is used, the head support unit and the foot support unit each partially support the alternate support top and, taken collectively, support all the weight of the support top. As used herein, unless specified otherwise, the weight of the alternate support top includes the weight of the support top itself and any weight borne by the support top (e.g. the weight of any accessories and of the patient).

In the non-baseline configuration the adaptor and foot support unit cooperate to partially support the alternate support top so that the alternate support top extends footwardly beyond the foot support unit. This specification uses the term "overextend" and variants thereof to refer to extension of a support top footwardly beyond the foot support unit or headwardly beyond the head unit. In particular the alternate support top extends footwardly beyond the foot support unit by a prescribed distance $D_P$. The prescribed distance may be defined by a surgical access requirement. One example of a surgical access requirement may be seen by comparing FIGS. 1A and 1B to FIGS. 3A and 3B. If the surgeon stands to the right of the foot support unit as seen in FIGS. 1A and 1B, the surgeon is longitudinally separated from the patient by at least distance $D_{LONG}$, which may be unsatisfactory. If the surgeon is conducting surgery on the patient's cervical spine, she may be constrained to stand in the corner 122 defined by support unit base 60 and the edge 122 of the support top. As a result the surgeon may not be able to position herself or maneuver her body for best access to the surgical site. By contrast, in FIG. 3B the surgeon is less constrained. The surgeon can position herself laterally close to the patient, and can also step left or right (parallel to the longitudinal dimension of the surgical table). Indeed, the surgeon has access to the patient along the entire length of arc of access 124.

Alternatively or additionally the prescribed distance may be expressed in terms of anthropometric parameters. For example the prescribed distance may be 50% of the height of a 99th percentile mail so that up to 50% of a 99th percentile male patient (and a larger percentage of a smaller patient) can be positioned footwardly beyond the footwardmost edge 128 of the foot support unit. One source of anthropometric data is "The Measure of Man and Woman—Human Factors in Design" by Alvin R. Tilley, ISBN 0-471-09955-4.

Figure 5A:
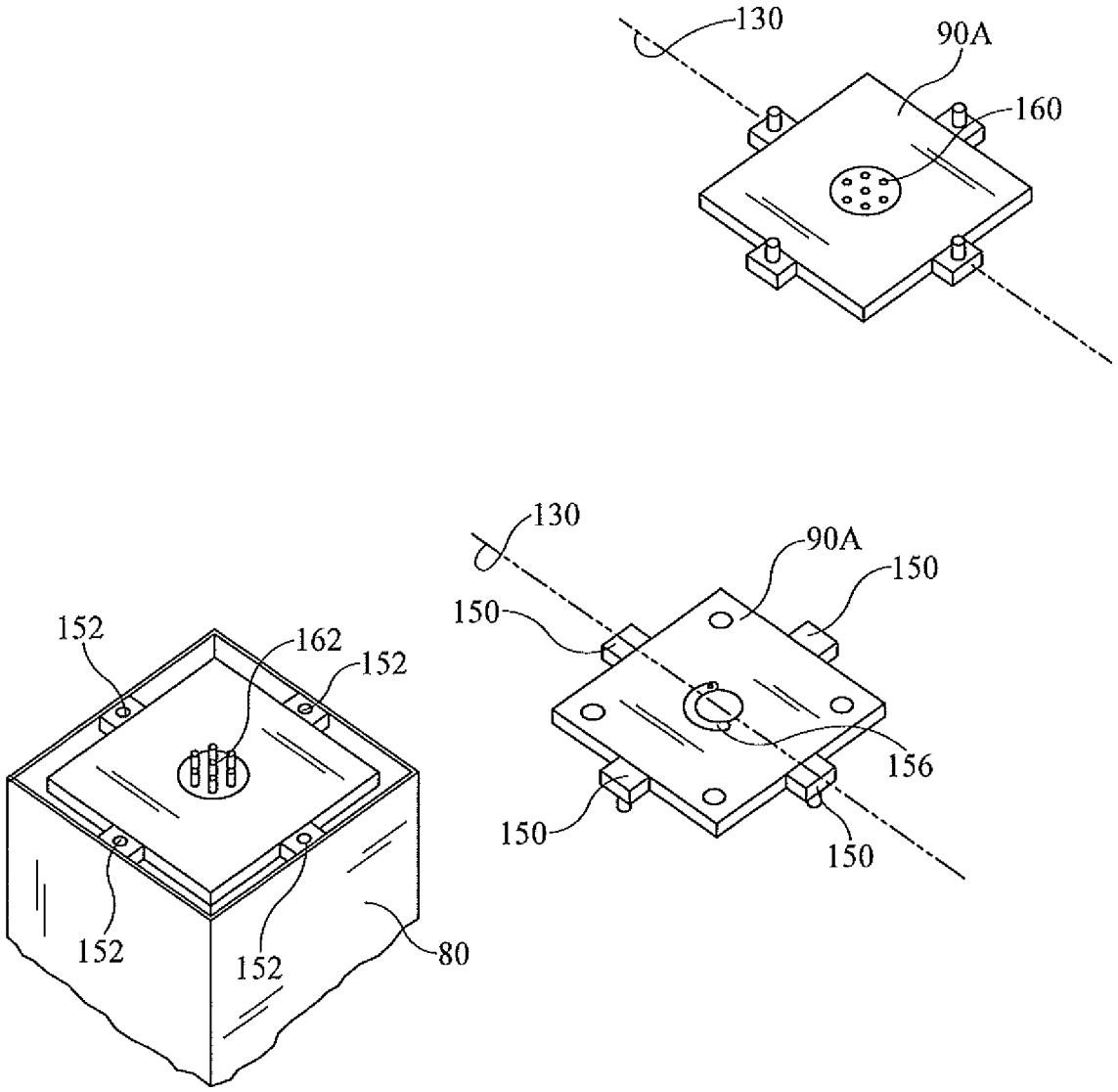
FIG. 5A is a view of a pedestal portion of a support unit and an adaptor component of the alternate configuration, the adaptor being illustrated in a standard orientation and an orientation in which it has been rotated 180 degrees about an axis to expose a connector.
Figure 5B:
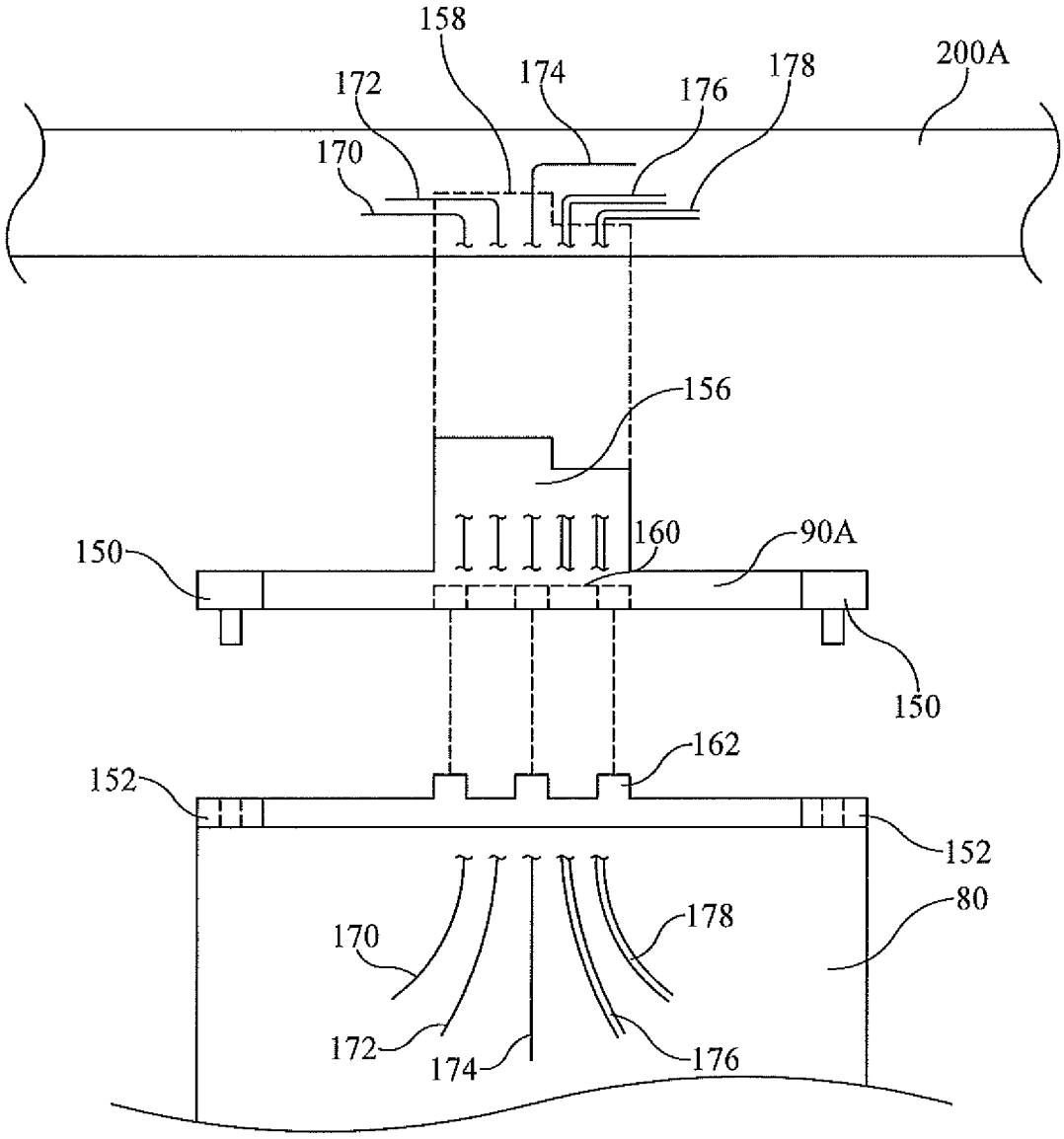
FIG. 5B is an exploded elevation view of the pedestal portion and adaptor of FIG. 5A, and an alternate support top.

FIGS. 5A and 5B show an example adaptor 90A as seen from above and as seen from below as a result of having been rotated 180 degrees about axis 130. The adaptor is securable to and removable from pedestal portion 80 of foot column 24. The adaptor and column include one or more connection or binding sites 150, 152 respectively. When the binding sites are engaged with each other the adaptor is securely connected to the pedestal so that the adaptor cannot be moved relative to the column in the horizontal or vertical directions, nor can it rotate relative to the column. When the binding sites are disengaged from each other, the adaptor can be removed from the column by sliding it horizontally toward head support unit 22 in much the same way that the crown of the baseline configuration is shown being removed in FIG. 1C. Removal in the longitudinally headward direction has the advantage that when a support top is connected to both the head support unit 22 and the foot support unit 24, the units themselves prevent unintended movement of the adaptor toward the head support unit. The top side of the adaptor includes a first connector 156 which cooperates with a mating element or connector 158 on the underside of the support top to keep the support top securely connected to the adaptor, and therefore to the pedestal. Connector 156 may also convey services such as electricity 170, electrical grounding 172, data 174, hydraulic fluid 176 and pneumatic fluid 178.

The bottom side of the adaptor includes a connector 160. The pedestal includes a mating connector 162. The connectors convey a service to the alternate support top or to accessories attached to the alternate support top. Example services include electrical energy 170, electrical grounding 172, data 174, hydraulics 176 and pneumatics 178 (e.g. hydraulic fluid or air to power accessories).

As already noted, use of "head" and "foot" is used herein to distinguish between distinct support units. In the examples of FIGS. 1A-4 only one of the two support units, specifically the unit closer to the right side of the illustration, is shown as being reconfigured to accommodate an alternate support top. However the foregoing description applies equally to the support unit illustrated closer to the left side of the illustration by simply redesignating that unit as the foot unit and the other unit as the head unit. Moreover both units can be reconfigurable between a baseline configuration and an alternate configuration.

Figure 6:
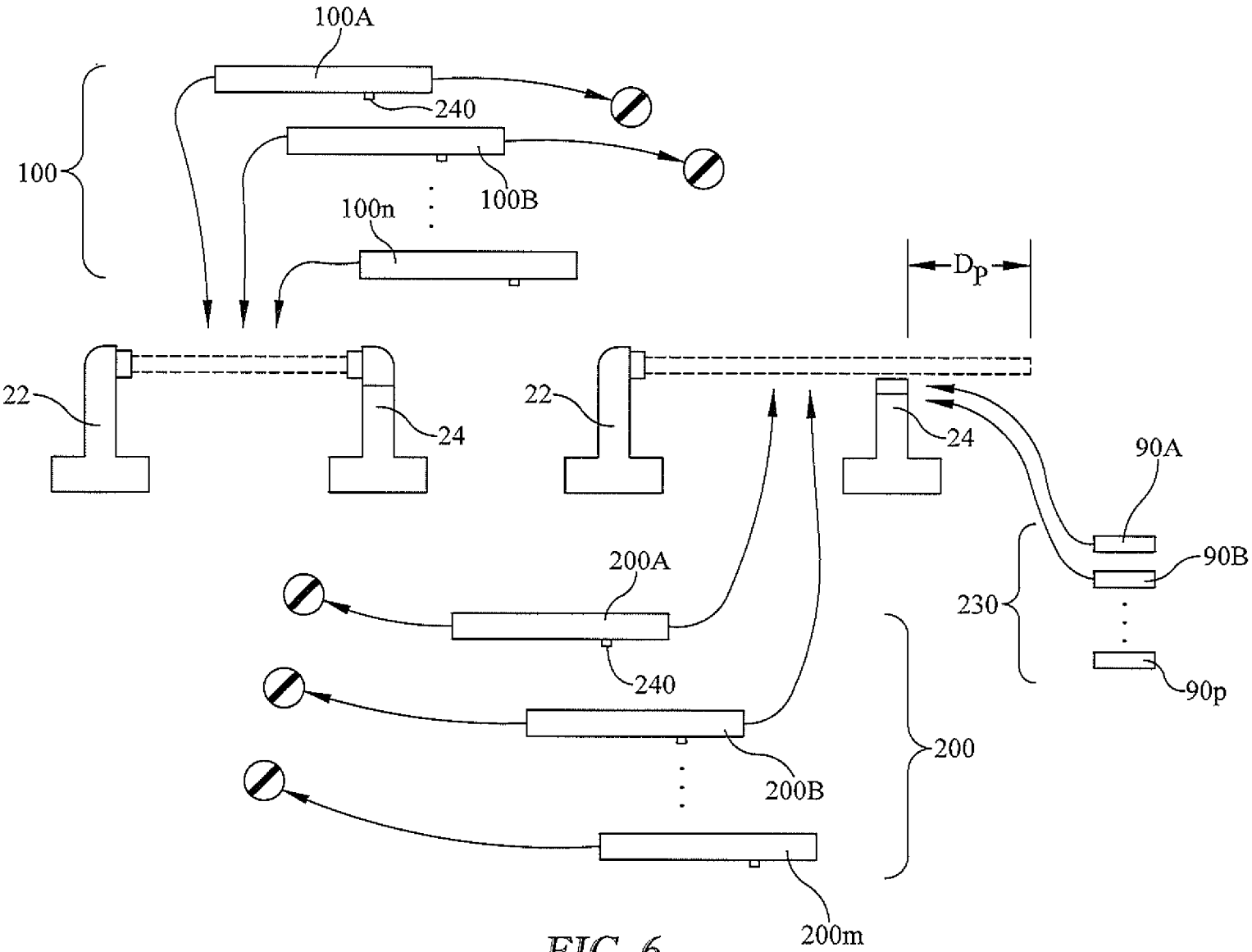
FIGS. 6-8 are diagrams of a patient support system configurable in a baseline configuration which includes a first or baseline set of support tops and an alternate configuration which includes a second or alternate set of support tops.

FIG. 6 illustrates the general concept of a patient support system. The system includes a head support unit 22, and a foot support unit 24 longitudinally spaced from the head support unit. As seen at the center left of the illustration the head support unit and the foot support unit are in a baseline configuration. The baseline configuration of the patient support system includes a first or baseline set 100 of support tops comprising n members 1 through n, and identified individually by 100A, 100B, and so forth. The first set of support tops has at least one member and may have two or more members. Each member of the first set of support tops is supportable partially by the baseline configured head support unit and partially by the baseline configured foot support unit as signified by the arrows leading from the members of the first set to the space between the baseline configured support units.

The system also includes a second or alternate set 200 of support tops comprising m members 1 through m, and identified individually by 200A, 200B, and so forth. The second set of support tops has at least one member and may have two or more members. The members of the second set of support tops are unsupportable by the combination of the baseline configured head support unit and the baseline configured foot support unit. In other words although the baseline configured head support unit may be able to partially support one end of a member of the second set, the baseline configured head support unit and the baseline configured foot support unit, acting together, cannot provide complete and satisfactory support for any of the members of the second set of support tops. This incompatibility is signified by the interrupted arrows extending from the members of the second set toward the baseline configured support units at the center left of the illustration.

As seen at the center right of the illustration the foot support unit is reconfigurable to a non-baseline configuration so that each member of the second set of support tops is supportable partially by the head support unit and partially by the foot support unit. This compatibility is signified by the arrows leading from the members of the second set to the space between the non-baseline configured support units. At least one member of the second set, when supported by a non-baseline configured foot support unit, extends footwardly beyond the foot support unit by a prescribed distance $D_P$. The members of the first set of support tops are unsupportable by the head support unit and the non-baseline configured foot support unit. This incompatibility is signified by the interrupted arrows extending from the members of the first set toward the support units at the center right of the illustration.

The patient support system also includes a group 90 of adaptors comprising p members 1 through p, and identified individually by 90A, 90B, and so forth. The adaptor set 90 has at least one member and may have two or more members. The adaptor or adaptors of the adaptor set are used in the way already described to effect the reconfiguration of the foot support unit to the non-baseline configuration. The illustrated adaptor set includes at least a first adaptor 90A useable to effect reconfiguration of a specified one of the two support units (either the head support unit 22 or the foot support unit 24) to the non-baseline configuration in order to accommodate connection of a member of the second set of support tops. The illustrated adaptor set may also include a second adaptor (e.g. 90B) useable to effect reconfiguration of the specified one of the two support units to the non-baseline configuration for a different member of the second set of support tops.

Figure 7:
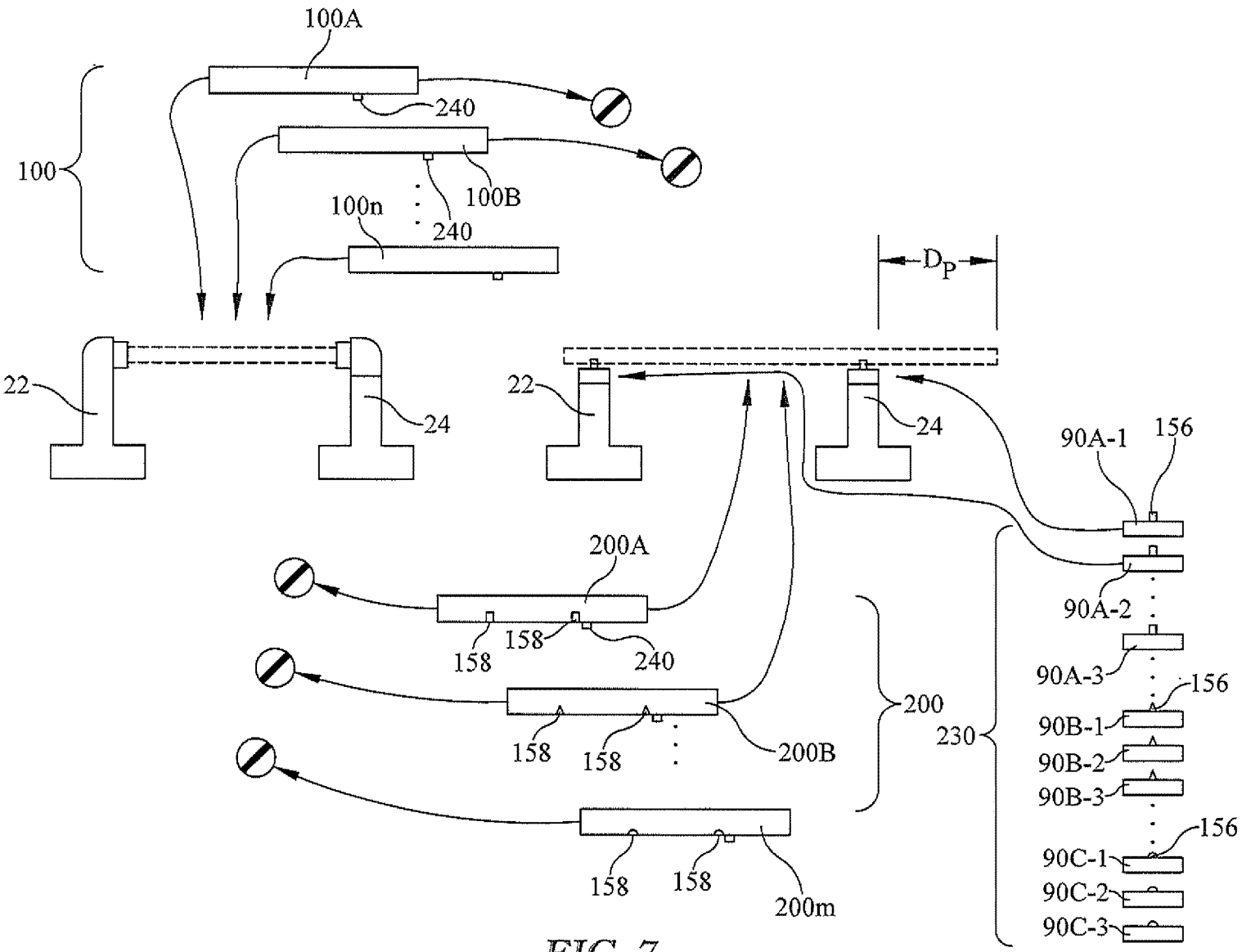

FIG. 7 is similar to FIG. 6 but shows an embodiment of the patient support system in which both the head and foot support units are reconfigured from the baseline state to the non-baseline state in order to support a member of the second set of support tops. The letter suffixes A, B, etc. applied to numeral 90 indicate different styles of adaptors, e.g. adaptors that differ from each other in order to accommodate differences among the members of the set of alternate support tops. The hyphenated numerals "−1", "−2", etc. indicate that the inventory of adaptors includes multiple adaptors of the style indicated by the letter suffix. As illustrated in FIG. 7 the adaptors used at the head support unit 22 and the adaptor used at the foot support unit 24 are physically the same as each other and are therefore interchangable between the support units. That is, adaptor 90A-1 can be used to reconfigure the foot support unit and adaptor 90A-2 to reconfigure the head support unit, or vice versa for a given style of top, e.g. top 200A.

Figure 8:
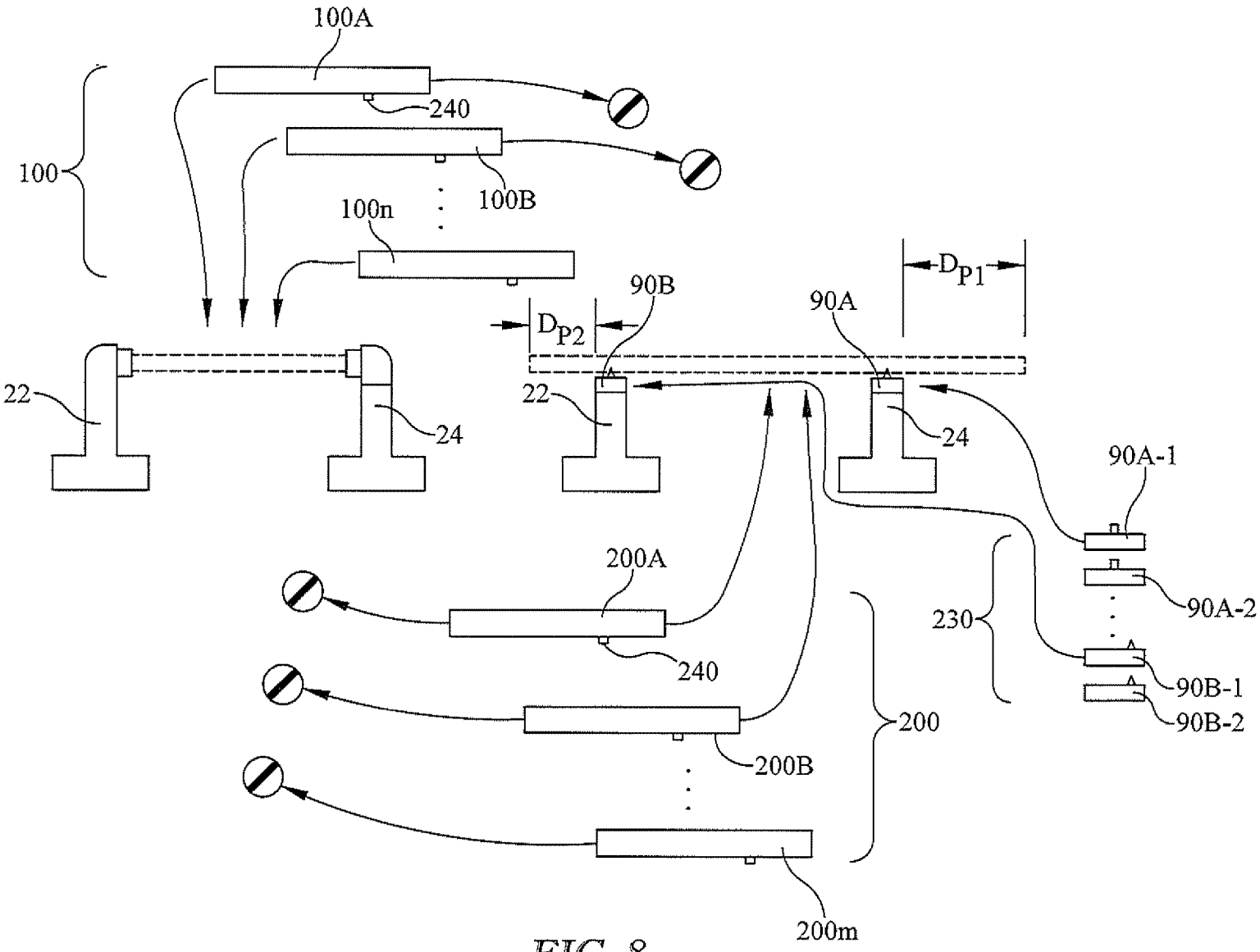

FIG. 8 is similar to FIG. 7 except that the adaptor used to effect the reconfiguration of head support unit 22 from the baseline state to the non-baseline state and the adaptor used to effect the reconfiguration of foot support unit 24 are physically different from each other and therefore are non-interchangable between the support units. In other words, for at least one support top from the second set, an adaptor 90A (selected from the sub-group of identical adaptors 90A-1, 90A-2, . . . ) is the adaptor required to achieve compatibility between the support top and the head support unit 22, while an adaptor 90B (selected from the group of identical adaptors 90B-1, 90B-2, . . . ) is the adaptor required to achieve compatibility between the support top and the foot support unit 24.

Continuing to refer to FIGS. 7-8, FIG. 8 shows that at least one member of the second set of support tops, when supported by a non-baseline configured unit, overextends footwardly (i.e. extends footwardly beyond the foot support unit) by a prescribed distance $D_{P1}$ and overextends headwardly (i.e. extends headwardly beyond the head support unit) by a prescribed distance $D_{P2}$. FIG. 7 shows that at least one member of the second set of support tops, when supported by a non-baseline configured unit, overextends footwardly by a prescribed distance but does not overextend headwardly. In yet another alternative, not illustrated, at least one member of the second set, when supported by a non-baseline configured unit, overextends headwardly by a prescribed distance but does not overextend footwardly. Once again the prescribed distances can differ from each other.

FIG. 7 shows a support top which overextends in only one direction in the context of interchangeable adaptors. FIG. 8 shows a support top which overextends in both directions in the context of non-interchangeable adaptors. However the patient support system may, alternatively or additionally, include adaptors and alternate tops such that the tops overextend in only one direction with non-interchangable adaptors and tops that overextend in both directions with interchangable adaptors.

In view of the foregoing certain details of the patient support device can now be better appreciated. Referring to FIG. 1C the crown is detachable from and attachable to the pedestal in a longitudinally horizontal direction. The crown and pedestal include latch components 230, 232. When the latch is engaged the crown is securely connected to the foot column so that the crown cannot be move relative to the column in the horizontal or vertical directions, nor can it rotate relative to the column. When the latch is disengaged, for example by operation of a user accessible trigger 234, the crown can be removed from the column by sliding it horizontally toward head support unit 22. Removal in the longitudinally headward direction (i.e. toward the other support unit) has the advantage that when a support top is connected to both the head support unit 22 and the foot support unit 24, the units themselves prevent unintended movement of the crown toward the head support unit.

Referring to FIGS. 1A, 3A, 4, and 6-8, the members of the first support top set and/or the members of the second support top set may include an identification element 240. In one example the identifying element is an RFID tag which is readable by an RFID reader located, for example, on or in the foot column. In another example the identifying element is a sensor or exciter of a Hall effect sensor pair. Irrespective of the technology employed, the identification element provides information about the identity of the support top. For example the identification element may provide information to a processor so that the processor can enforce support top specific limitations based on the types of surgery for which the support top is acceptable. Example limitations include maximum allowable speed at which a particular type of support top can be raised or lowered by the column, the maximum or minimum allowable height to which the support top can be raised or lowered and the maximum inclination allowed for the support top.

As is evident from the foregoing description, the adaptor is removable from its host support unit thereby rendering the foot support unit reconfigurable to a baseline configuration in which a baseline support top is supportable by the support unit. The support unit is considered to be reconfigurable to a baseline configuration in the sense that crown 82 can be installed on pedestal 80 subsequent to removal of adaptor 90A in order to achieve the baseline configuration. In another embodiment the crown is not required to achieve the baseline configuration because pedestal 80, standing alone without the crown, is capable of providing the needed support for the baseline support top. In that case the removal of the adaptor converts the support unit to the baseline configuration rather than putting it in a condition for being reconfigured to the baseline configuration (by attaching a crown).

Crown 82 and the members of the adaptor set 90 have been described as slidably removable from pedastal 80 by being slid toward the opposite support unit. However other directions of removal such as being slid away from the other support unit, being removed laterally, and being removed vertically may also be satisfactory.

Although this disclosure refers to specific embodiments, it will be understood by those skilled in the art that various changes in form and detail may be made without departing from the subject matter set forth in the accompanying claims.

We claim:

1. A patient support device comprising:

an alternate support top;

a head support unit partially supporting the alternate support top;

a foot support unit longitudinally spaced from the head support unit;

a connecting member interconnecting the head support unit and the foot support unit, the connecting member extending longitudinally between the head support unit and the foot support unit and being adjustable in length; and an adaptor associated with the foot support unit;

the adaptor being securable to the foot support unit so that, when the connecting member is adjusted to be in a shortened position, the adaptor and foot support unit cooperate to partially support the alternate support top so that the alternate support top extends footwardly beyond the foot support unit, wherein an upper end of the head support unit is higher in elevation than a head end of the alternate support top and an upper end of the foot support unit is situated beneath the alternate support top.

2. The device of claim 1 wherein the adaptor and foot support unit cooperate to partially support the alternate support top so that the alternate support top extends footwardly beyond the foot support unit by a prescribed distance.

3. The device of claim 2 wherein the prescribed distance is defined by a surgical access requirement.

4. The device of claim 2 wherein the prescribed distance is defined by a portion of the alternate support top that extends in a cantilevered manner longitudinally beyond the foot support unit.

5. The device of claim 1 wherein the foot support unit includes a base and a pedestal extending vertically upwardly from the base, the foot support unit being configurable in: a) a baseline configuration in which a crown, which is incompatible with supporting the alternate support top, resides atop the pedestal and; b) a non-baseline configuration in which the adaptor, which is compatible with supporting the alternate support top resides atop the pedestal in lieu of the crown.

6. The device of claim 1 wherein the adaptor includes a connector which conveys a service to the alternate support top or to accessories attached to the alternate support top.

7. The device of claim 6 wherein the service is at least one of electrical energy and data.

8. The device of claim 1 wherein the alternate support top includes an identification element.

9. The device of claim 1 wherein:

the head support unit partially supports the alternate support top at a first end of the alternate support top;

the adaptor and foot support unit cooperate to partially support the alternate support top so that the alternate support top extends footwardly a prescribed distance beyond the foot support unit;

the adaptor also being removable from the foot support unit thereby converting the foot support unit to or rendering the foot support unit reconfigurable to a baseline configuration in which a baseline support top is supportable by the foot support unit at a footward end of the baseline support top.

10. The device of claim 9, wherein the connecting member is in a lengthened position when the foot support unit is in the baseline configuration.

11. The device of claim 10, wherein the connecting member is configured to telescope when moving between the shortened position and the lengthened position.

12. The device of claim 1, wherein the head support unit and the foot support unit each includes a telescopic column configured to lengthen and shorten in a vertical direction.

13. The device of claim 12, wherein the connecting member is adjustable in a horizontal direction.

14. The device of claim 1, wherein the head support unit and the foot support unit are each configured to selectively extend and retract vertically to change an elevation of the alternate support top relative to the connecting member.

15. The device of claim 1, wherein the foot support unit comprises a pedestal and wherein the adaptor is situated atop the pedestal.

16. The device of claim 15, wherein the pedestal and the adaptor are configured so that the adaptor is slid relative to an upper end of the pedestal away from the head support unit to attach the adaptor to the pedestal and the adaptor is slid relative to the upper end of the pedestal toward the head support unit to detach the adaptor from the pedestal.

17. The device of claim 16, wherein, when the adaptor is attached to the pedestal, attachment of the alternate support top to the adaptor prevents the adaptor from being able to slide toward the head support unit to prevent detachment of the adaptor from the pedestal.

18. The device of claim 16, further comprising binding sites that engage with each other to securely connect the adaptor to the pedestal.

* * * * *